US006634821B2

(12) United States Patent
Gueret

(10) Patent No.: US 6,634,821 B2
(45) Date of Patent: Oct. 21, 2003

(54) DEVICE, SYSTEM, AND METHOD FOR APPLYING A PRODUCT

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 09/984,324

(22) Filed: Oct. 29, 2001

(65) Prior Publication Data

US 2002/0057939 A1 May 16, 2002

(30) Foreign Application Priority Data

Oct. 27, 2000 (FR) ..... 00 13864

(51) Int. Cl.[7] ..... A46B 11/00
(52) U.S. Cl. ..... 401/126
(58) Field of Search ..... 401/126, 127, 401/130, 123, 124, 125, 121, 119, 118

(56) References Cited

U.S. PATENT DOCUMENTS

| | | | | | |
|---|---|---|---|---|---|
| 2,554,302 | A | * | 5/1951 | Keskitalo | 222/187 |
| 2,554,489 | A | * | 5/1951 | Crane | 401/125 |
| 5,492,426 | A | | 2/1996 | Gueret | |
| 5,636,931 | A | | 6/1997 | Gueret | |
| 5,876,139 | A | | 3/1999 | De Laforcade | |
| 5,890,828 | A | | 4/1999 | Gueret | |
| 6,296,410 | B1 | * | 10/2001 | Ruizendaal | 401/119 |
| 6,309,124 | B1 | * | 10/2001 | Gueret | 401/124 |

FOREIGN PATENT DOCUMENTS

| | | |
|---|---|---|
| DE | 92 07 228 | 10/1992 |
| DE | 196 34 119 | 2/1998 |
| EP | 1 020 135 | 7/2000 |
| FR | 2 701 818 | 9/1994 |
| FR | 2 754 458 | 4/1998 |
| FR | 2 788 501 | 7/2000 |

OTHER PUBLICATIONS

English Translation of DE 92 07 228.3.
English language Derwent Abstract of DE 196 34 119, Feb. 26, 1998.
English language Derwent Abstract of EP 1 020 135, Jul. 19, 2000.
English language Derwent Abstract of FR 2 788 501, Jul. 21, 2000.

* cited by examiner

*Primary Examiner*—Gregory L. Huson
*Assistant Examiner*—Huyen Le
(74) *Attorney, Agent, or Firm*—Finnegan, Henderson, Farabow, Garrett & Dunner, LLP

(57) ABSTRACT

A device and system for applying a product, for example, a cosmetic product, may include a first compartment containing the product, and a second compartment in flow communication with the first compartment via at least one supply orifice, with the second compartment having an opening which may be removably closed by a closure element. The second compartment may form a housing for an applicator which is insoluble with respect to the product. The applicator may rest against an elastically compressible porous member that may be in flow communication with the supply orifice.

64 Claims, 4 Drawing Sheets

DEVICE, SYSTEM, AND METHOD FOR APPLYING A PRODUCT

The present invention relates to a device, system, and method for applying a product, for example, a cosmetic product. The invention may be used for applying liquid or semi-liquid products, such as those products in the form of a milk, an emulsion, a lotion, a perfume, an eau de toilette, or a gel. For example, the product may be a care product for application to skin, such as a lotion and/or cream. Additionally, the product may be a cosmetic product, a lip care product, a lip make-up product, a nail varnish, a hair product such as a treatment product or hair coloring product, and/or any other product desired to be applied to a surface.

FR-A-2 701 818 describes a unit including a reservoir containing a product for application, a cap for closing the reservoir, and an elastically deformable applicator element. The product reservoir is bounded by a capillary end piece in the form of a thimble having a rigid bottom pierced for forming at least one capillary orifice against which the applicator element is deformed when the reservoir is closed by the cap.

FR-A-2 754 458 describes an applicator unit having an applicator comprising a product capable of dissolving or becoming gel-like at its surface upon contact with a liquid composition contained in a first housing that may be located adjacent a second housing that contains the applicator.

An optional aspect of the invention is to produce a packaging and applicator unit that may solve one or more of the problems discussed hereinabove with reference to the conventional units.

Another optional aspect of the invention is to provide a packaging and applicator unit that may allow the use of applicators of relatively rigid consistency.

Yet another optional aspect of the invention is to provide a packaging and applicator unit that may allow the use of products having a very low viscosity.

Another optional aspect of the invention is to produce a unit that, during use, may preserve the application characteristics of the applicator, such as the comfort level during use.

According to a first optional aspect of the invention, a device for applying a product comprises a first compartment for containing a product, a second compartment forming an applicator housing and defining an opening, at least one supply orifice configured to provide flow communication between the first compartment and the second compartment, and an at least partially elastically compressible porous member in flow communication with the at least one supply orifice. The device may further comprise a closure element for removably closing the opening and an applicator substantially formed from at least one of an elastomeric material, a foam material, a sintered material, and a felt. The applicator may be configured to be placed in the applicator housing so that the applicator contacts the at least partially elastically compressible porous member.

According to a second optional aspect of the invention, a system for applying a product includes a first compartment, a product contained in the first compartment, a second compartment forming an applicator housing and defining an opening, at least one supply orifice configured to provide flow communication between the first compartment and the second compartment, and an at least partially elastically compressible porous member in flow communication with the at least one supply orifice. The system may further comprise a closure element for removably closing the opening and an applicator configured to be insoluble with respect to the product. The applicator may be configured to be placed in the applicator housing so that the applicator contacts the at least partially elastically compressible porous member.

According to another optional aspect of the invention, the system may include an applicator secured to the closure element such that the closure element acts as a member for holding the applicator.

According to yet another optional aspect of the invention, the at least partially elastically compressible porous member may include at least one of an open-cell hydrophilic foam, a semi-open-cell hydrophilic foam, a flexible sintered material, and a felt.

In an additional optional aspect of the invention, the at least partially elastically compressible porous member may comprise at least one of polyurethane and polyether.

In yet another optional aspect of the invention, the at least partially elastically compressible porous member may comprise at least one of ethylene vinyl alcohol and polyvinyl chloride.

According to another optional aspect of the invention, the at least partially elastically compressible porous member may be at least partially covered with a sheet of material that is permeable with respect to the product.

According to yet another optional aspect of the invention, the sheet of material may comprise at least one of a woven film, a non-woven film, and a perforated thermoplastic film.

In an additional optional aspect of the invention, the at least partially elastically compressible porous member may contain at least one of a bacteriostatic agent and a hydroabsorbent agent.

In another optional aspect of the invention, the applicator may comprise at least one of a rigid and a semi-rigid material.

In yet another optional aspect of the invention, the applicator may comprise at least one of a thermoplastic material, a felt, and a sintered material.

According to another optional aspect of the invention, the applicator may comprise an elastically compressible material.

According to yet another optional aspect of the invention, the applicator may comprise at least one of an open-cell foam, a semi-open-cell foam, and an elastomer.

In an additional optional aspect of the invention, the applicator may be at least partially covered with flocking.

According to an additional optional aspect of the invention, the flocking may comprise at least one of rayon, nylon, viscose, silk, and polyester.

In yet another optional aspect of the invention, the system may further comprise a perforated element affixed between the first compartment and the second compartment, with the perforated element defining the at least one supply orifice, and the at least partially elastically compressible porous member being located in the second compartment adjacent the perforated element.

In an additional optional aspect of the invention, the at least partially elastically compressible porous member may be secured to the perforated element.

According to another optional aspect of the invention, the system may further comprise an annular rim defining the at least one supply orifice, wherein the at least partially elastically compressible porous member is positioned in the second compartment via the annular rim.

According to yet an additional optional aspect of the invention, the at least partially elastically compressible porous member may be secured to the annular rim.

In another optional aspect of the invention, the at least partially elastically compressible porous member may be fixed at an axial position inside the second compartment.

According to another optional aspect of the invention, the system may further comprise a pump, wherein the pump supplies product from the first compartment to the second compartment.

In another optional aspect of the invention, the pump may be configured to be actuated via pressure applied against the bottom of the first compartment.

In an additional optional aspect of the invention, the first compartment may comprise a bottle having substantially rigid walls defining a fixed volume.

According to another optional aspect of the invention, the first compartment may have a variable volume.

According to yet another optional aspect of the invention, the first compartment may further comprise at least one of at least one deformable wall, a bellows, and a bottom forming a piston.

In another optional aspect of the invention, a method of applying a product comprises providing the system according to any one of the previously mentioned optional aspects of the invention. The method may further comprise transferring product from the first compartment to the at least partially elastically compressible porous member, loading the applicator with product from the at least partially elastically compressible porous member, removing the closure element from the opening, and applying the product with the applicator.

According to another optional aspect of the invention, the product may comprise at least one of one of a makeup product, a care product, a personal hygiene product, and a hair product.

According to yet another optional aspect of the invention, the product may comprise at least one of a perfume, an eau de toilette, a milk, a lotion, an emulsion, a gel, a lipstick product, a foundation, and a hair product for applying at least one of highlights and lowlights.

In an additional optional aspect of the invention, transferring product to the at least partially elastically compressible porous member may comprise at least partially inverting the system.

In another optional aspect of the invention, transferring product to the at least partially elastically compressible porous member may comprise shaking the system.

According to yet another optional aspect of the invention, the first compartment may comprise at least one elastically deformable wall and transferring product to the at least partially elastically compressible porous member may comprise deforming the at least one elastically deformable wall.

In another optional aspect of the invention, transferring product to the at least partially elastically compressible porous member may comprise activating a pump.

According to an optional aspect of the invention, transferring product to the at least partially elastically compressible porous member may comprise placing a valve in an open position.

Within the meaning of this application, the terms "not soluble" or "insoluble" used to quantify the applicator mean that, unlike FR-A-2 754 458 mentioned hereinabove, contact between the applicator and the product that is to be applied does not alter the integrity of the applicator. In other words, the applicator does not become consumed, does not break up, does not dissolve, and does not turn to gel when in contact with the product contained in the first compartment. Such an applicator may be in the form of a foam, a felt, a sintered material, an elastomer or any other material, such as a thermoplastic material. The consistency of the applicator may be rigid or semi-rigid. The material from which the applicator is made may be optionally porous.

Additionally, the term "providing" and forms thereof, are used in a broad sense, and refer to, but are not limited to, making available for use, enabling usage, giving, supplying, obtaining, getting a hold of, acquiring, purchasing, selling, distributing, possessing, making ready for use, and/or placing in a position ready for use.

Since the porous element may become fully loaded with product, it may form a reserve of product that is far greater than that obtained with a rigid seat as described in FR-A-2 701 818. As the application surface of the applicator contacts this reserve, it may quickly become fully loaded with product as the unit is opened and the porous element expands.

Furthermore, if the applicator is rigid, because it rests on a flexible seat comprising an elastically compressible member, the elastically compressible member may deform and conform to the shape of the applicator. This may result in an increase in the contact area between the applicator and the porous element. As a result, this may allow the applicator to become more fully loaded with product.

Contact between the applicator and the compressible seat may be gentle. As a result, the condition of the surface of the applicator may be not adversely affected by the friction that may occur between the applicator and the porous member during opening of the unit.

Upon opening the unit through removal of the cap from the unit, the application surface of the applicator may be wiped, leaving very little excess product on the application surface. This characteristic may be enhanced if the applicator is rotated with respect to the porous member as the applicator is removed. This may prevent excess drops of the product from remaining on the application surface. This characteristic may be much less pronounced in units where the seat on which the applicator rests is rigid.

Additionally, the material of the porous member may form a barrier to the product that may be capable of appreciably limiting any evaporation of any solvents that may be contained in the product, and may also be capable of limiting the risk of the product spilling from the unit if the unit is tipped or overturned.

At least the part of the applicator that contacts the porous member may be elastically compressible. As an option, the entire porous member may be elastically compressible. The compressibility of the porous member may be uniform, such as in the case of a porous member formed from a single foam material, or variable, such as in the case of a porous member formed from a stack of several blocks of foam having different densities.

In situations in which the flexible seat is formed from a block of foam having large-sized open cells, it may be desirable to cover at least a portion of the block with a product-permeable sheet, such as a woven, a non-woven, or a perforated thermoplastic film. This may result in an improved ability of the flexible seat to prevent the product from evaporating or spilling from the device, such as when the device is overturned. This characteristic may be further enhanced when the foam block is substantially loaded with product. Furthermore, the product-permeable sheet may also reduce the harshness of the frictional contact between the applicator and the flexible seat, thereby reducing the risk of damage to the surface of the applicator.

Reversible attachment of the closure element to the unit may optionally be provided by snap-fastenings, screw fastenings, or a bayonet system.

The elastically compressible porous member may comprise a block of open-cell or semi-open-cell hydrophilic foam, such as polyurethane or polyether foam. Alternatively, the elastically compressible porous member may be formed from a flexible sintered material, such as ethylene vinyl alcohol (EVA), polyvinyl chloride (PVC), or of a low-density felt. Optionally, the porosity of the material may be selected such that even at saturation and in the absence of pressure, product may not flow from the porous element. Such an ability to retain the product, even at saturation, may be improved by incorporating hydroabsorbent agents into the porous material.

Such a porous member may be formed from a block, such as foam block, whose thickness in an uncompressed state may range from about 1 millimeter to about several millimeters.

Apart from "natural" passages through the porous member, which may comprise the pores of the material, it may be possible to provide one or more "artificial" passages in the form of slits or of any other passage passing axially through the thickness of the block of porous material. Such passages, as in the case of more viscous products, may encourage product to pass between the reservoir and the housing containing the applicator.

The porous member may furthermore contain bacteriostatic agents, thereby reducing the amount of preservative required to be incorporated directly into the product itself.

Optionally, the applicator may be formed from an elastically compressible material, such as an open-cell or semi-open-cell foam, or of an elastomer. The compressibility of the applicator may be lower than, or similar to, that of the elastically compressible porous member.

As another alternative, the applicator may be formed from an elastomeric material. In this form, the applicator may be configured in the form of a solid or hollow structure in order to provide the applicator with greater deformability. This deformability may become more apparent upon contact with a surface to which the product is to be applied.

At least part of the surface of the applicator may be covered with flock formed from materials such as rayon, nylon, cotton, silk, polyester, or viscose. Whether flock is present may depend on considerations such as the rheology of the product that is to be applied, on the material of which the applicator is made, on the ability of the applicator to deeply absorb product, and on the characteristics desired for application such as the comfort level to the user. The flock may contain a mixture of fibers having a different a nature and/or cross sections and/or having different lengths.

Optionally, the porous member may include at least a part, such as an annular part, which is at a fixed axial position inside the unit. A perforated element, such as a grating, a holed bottom, a sieve, or a perforated film, may be formed or held fixedly between the first compartment and the second compartment, with the perforated element defining at least one supply orifice, and with the elastically compressible porous member being arranged in the second compartment above the perforated element. In such an arrangement, the perforated element may form a rigid support for the porous member, thereby preventing the porous member from being deflected toward the container when the applicator rests on the porous member.

A perforated element such as previously described may also form an element capable, either by capillary action or by a surface tension effect, of holding a certain amount of product directly in contact with the surface of the porous block, thereby further improving the impregnation of the porous block with the product. The configuration of the perforated element, such as the number, the size, and the density of the holes, may depend on the rheology of the product, on the characteristics of the applicator, such as its compressibility, and/or on the desired characteristics for application, such as the amount of product to be applied in each application.

The elastically compressible porous element may optionally be held in the second compartment via an annular rim delimiting a central supply orifice. Thus, when the applicator is resting on the flexible seat, the flexible seat, apart from elastic compression, may be deflected toward the bottom of the container. This may result in the contact area between the applicator and the flexible seat being improved. The elastically compressible porous element may be secured, such as by bonding, to the perforated element or the annular rim.

The second compartment may be supplied from the first compartment via a manually operated dispenser means, such as a pump or a valve. An outlet orifice at the end of a stem of the dispenser means may optionally open directly into the porous element. Such an embodiment using a dispenser means may be well suited to products having a greater viscosity. Such a dispenser means may be of the type having an air intake or may be of the airless type.

The dispenser means may be actuated via pressure exerted on the rigid bottom of the first compartment. A packaging and dispensing unit using at least one optional aspect of such a dispenser means is described in FR-A-2 788 501. This document describes some, but not all, various possible configurations of a dispenser means having at least one similar characteristic.

The first compartment may be of fixed volume, such as in the case of a rigid-walled bottle. In the case of a product having a low viscosity, such as a perfume, a glass container may be used. In such situations, an elastically compressible porous element may be brought into contact with the product by shaking the container with some degree of vigor. This may occur naturally in the case of a product such as a perfume that a consumer might carry around in a handbag. The product may impregnate the block of foam such as by capillary action or by a surface tension effect. As in another embodiment, the product may also be conveyed into the porous element by a dispenser means, such as by a pump connected to a dip tube.

The first compartment may optionally be of variable volume and may comprise a container having elastically or non-elastically deformable walls. For example, a tube may be used, the flexible walls of which may be deformed in response to pressure on the walls. The walls may or may not return to their initial position when the pressure is released. As a result of the pressure on the flexible walls, the pressure inside the container may force product, such as through capillary action, into the vicinity of the porous element, such as through a grating supporting the porous element, or directly onto the porous element.

Pressure exerted on an optional bellows of the container may also be used to increase the pressure within the container.

In the optional case of a unit using an airless pump, the container may be equipped with a bottom that forms a follower piston. Each time there is pumping from the container, the piston may move up inside the container in such a way that it follows the product. Alternatively, the product may be packaged in a pouch, the flexible walls of which may deflect inward upon pumping action, so as to compensate for the volume of product dispensed.

The unit according to the invention may optionally be used for packaging and applying a makeup, a treatment product, a care product or a personal hygiene product, such as a perfume, an eau de toilette, a milk, a lotion, an emulsion, a gel, a lipstick product, a foundation or a hair product, such as for applying highlights and/or lowlights.

Aside from the structural and procedural arrangements set forth above, the invention could include a number of other arrangements, such as those explained hereinafter. It is to be understood that both the foregoing description and the following description are exemplary.

The accompanying drawings are incorporated in and constitute a part of this specification. The drawings illustrate optional embodiments of the invention and, together with the description, serve to explain some principles of the invention. In the drawings, FIG. 1A is a schematic cross-sectional view of an optional embodiment of a device for applying a product according to an optional aspect of the invention;

Figure 1A:
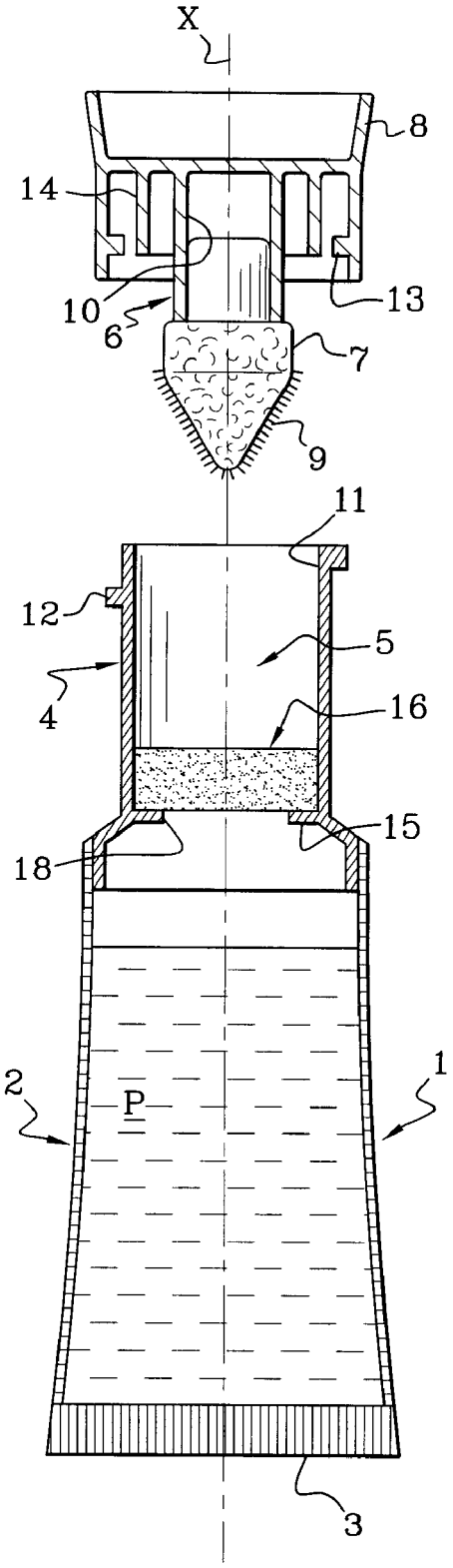
FIG. 1B is a schematic cross-sectional view of the embodiment of FIG. 1A with the applicator positioned in the housing.
Figure 1B:
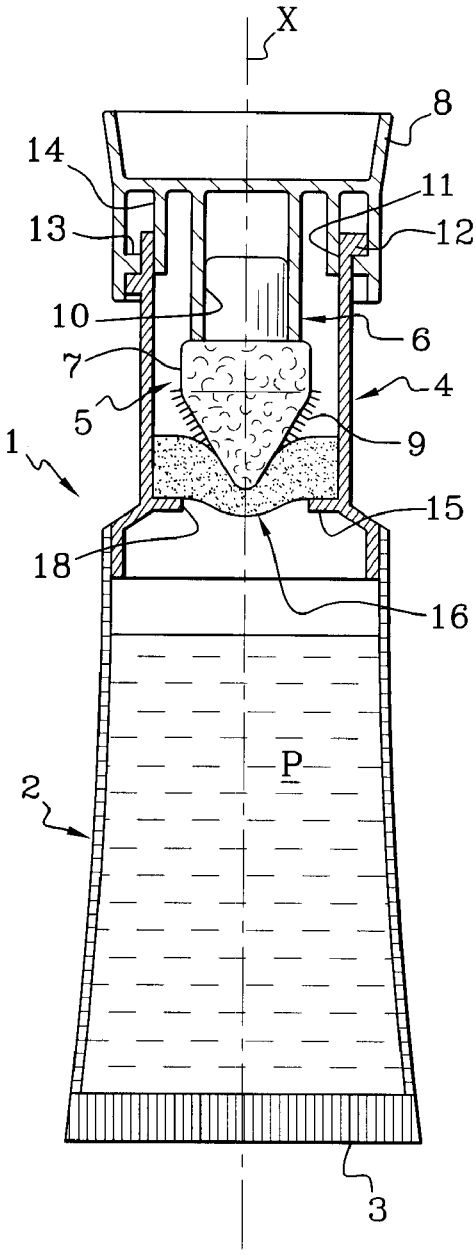

The applicator device 1 depicted in FIGS. 1A and 1B may include a container 2 in the form of a flexible-walled tube having an axis X. The container 2 may contain a reserve of product P, for example, a liquid lipstick. The bottom of the container 2 may be closed, for example, along a welded zone 3.

The open end of the container 2, at the opposite end to the exemplary welded zone 3, may be connected to an element 4, for example, by welding. The element 4 may define a housing 5 intended to house an applicator 6 through an opening 11. The applicator 6 may include an applicator element 7 and a member 8 for being held by the user, which may also constitute a cap for closing the housing 5. The applicator element 7 may be force-fitted into an axial chimney 10 formed by the applicator 6.

The applicator 6 may be held on the device 1 in such a way as to shut off the opening 11, for example, by means of a screw thread 12 formed on the exterior surface of the housing 5. The screw thread 12 may also be intended to cooperate with a corresponding screw thread 13 provided on an interior surface of the holding member 8. A sealing skirt 14 may allow the applicator 6 to seal the opening 11.

According to this optional embodiment, the applicator element 7 may comprise a thermoplastic sintered element, such as an applicator element 7 formed from polyethylene and having a surface which may be covered with flock 9. The free end of the applicator element 7 may form two faces that may be mitered so as to make it easier for the product P to be applied to the lips.

The interior surface of the housing 5 may have, near its bottom, an annular rim 15 forming an annular support for a block of foam 16, for example, an open-cell foam, that may be on the order of about 3 millimeters thick, for example. The annular rim 15 may delimit a central orifice 18. The block of foam 16 may be bonded to the annular rim 15.

The porosity of the block of foam 16 may be chosen so that the block of foam 16 may become impregnated with the product P when the product P is brought into contact with the block of foam 16. This may occur, for example, when the device 1 is shaken. Such shaking may be the natural result of the device 1 being carried in a handbag. The foam block 16 may be formed from a foam such as a polyether foam.

In an opened position, such as depicted in FIG. 1A, the housing 5 may be isolated from the container 2 by the block of foam 16 impregnated with product P. The product-impregnated block of foam 16 may form a "liquid barrier" capable of appreciably reducing the evaporation of product P contained in the tube 2. When the device 1 is turned head down, the product P may be prevented from flowing out of the device 1.

When the applicator 6 is mounted on the device 1, as shown in FIG. 1B, the applicator element 7 may rest against the block of foam 16 to the extent of compressing it and of appreciably deflecting it toward the bottom of the tube 2. This deflection may play a part in creating a significant area of contact between the applicator element 7 and the product-impregnated block of foam 16.

In one optional manner of using the device, the user may shake the device 1 so as to bring product P into contact with the block of foam 16. Some of the product P may deeply impregnate the block of foam 16. A certain amount of product P may be held by capillary action on the face of the block of foam 16 that faces towards the container 2. By pressing against the walls of the tube 2, the pressure inside the tube 2 may be increased, which may encourage the product P to pass through the block of foam 16 toward the surface that may be in contact with the applicator element 7.

Upon opening the device 1, the product P may be pumped toward the applicator element 7 by the effect of the block of foam 16 decompressing. Furthermore, upon opening, the optional relative rotation between the applicator element 7 and the block of foam 16 may allow the application surface to be wrung out so that any excess product P, such as in the form of drops that may have accumulated on the surface of the applicator element 7, may be removed. Thereafter, the product P may be applied in a conventional manner to a surface that is to be treated.

Figure 2A:
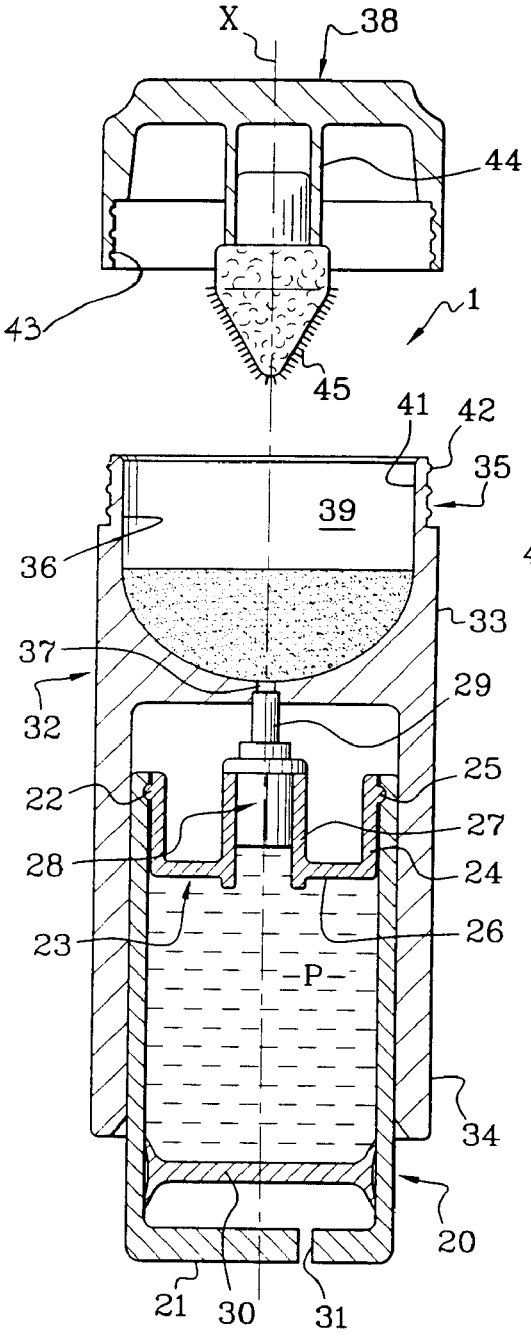
FIG. 2A is a schematic cross-sectional view of an additional optional embodiment of a device for applying a product.
Figure 2B:
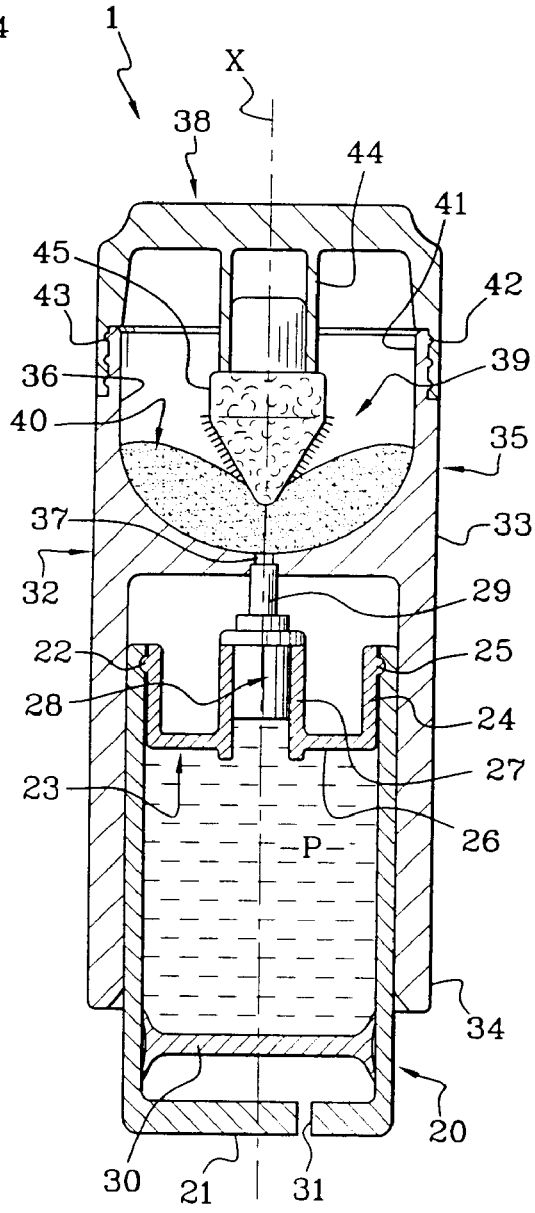
FIG. 2B is a schematic cross-sectional view of the embodiment of FIG. 2A with the applicator positioned in the housing.

In the optional embodiment illustrated in FIGS. 2A and 2B, to which reference is now made, the packaging and applicator unit 1 may comprise a rigid interior body 20 in the form of a cylindrical element made of polypropylene, for example. The cross section of the cylindrical element may be circular, ovoid, elliptical, polygonal, or any other desired shape. One end of the interior body 20 may be closed by a rigid bottom 21. The end of the rigid body 20 opposite to the bottom 21 may be open, and may have a groove 22 on its interior surface capable of allowing an intermediate part 23 to be snap-fastened thereto. The intermediate part 23 may comprise a lateral skirt 24, the exterior surface of which may have, near its upper edge, a bulge 25 that may be capable of combining with the groove 22 of the interior body 20 for snap-fastening. A transverse flange 26 may extend from an end of the lateral skirt 24 opposite its free edge. The lateral flange 26 may extend and connect to an axial chimney 27, which may be provided with, for example, a cylindrical cross section. An airless dispenser 28, such as an airless pump, surmounted by an emerging stem 29 that may produce a seal, may be mounted inside the axial chimney 27 by, for example, snap-fastening or screw fastening. Thus, the dispenser 28 may be secured to the structure that carries or forms the product reservoir.

The product P, for example, a lotion, may be contained inside the interior body 20, which may have a piston 30 capable of sliding in a sealed manner against the internal walls of the interior body 20 as the product P is dispensed. The rigid bottom 21 may have an orifice 31 capable of allowing the air to be taken into the rigid body 20 into a volume beneath the piston 30.

The unit may be surmounted by a band 32 mounted on the emerging stem 29 and a cylindrical portion 33, which forms a skirt, one end 34 of which may be open. The open end 34 may lie near the rigid bottom 21 of the interior body 20, which, when the dispenser 28 is in the rest position, emerges with respect to the end 34 by a height that may correspond at least to an actuating stroke of the dispenser 28. The cylindrical portion 33 may have an inside diameter slightly greater than the outside diameter of the interior body 20, so as to be able to slide freely on the interior body 20 when the dispenser 28 is actuated.

At the end opposite from the open end 34, the band 32 may have a portion 35, an interior surface 36 of which may delimit a hemispherical housing 39. The surface 36 may be interrupted, such as at a central region, with an orifice 37. A portion of the orifice 37 that is adjacent to the surface 36, may have a cross section slightly smaller than the outside diameter of the emerging stem 29 so that the emerging stem 29, when the dispenser 28 is actuated, abuts against the portion of smaller cross section of the orifice 37. The cylindrical portion 33 of the band 32 may be held so that an applicator cap 38 may be either screwed onto or off the band 32.

A block of foam 40, for example, polyurethane foam, may be held in the bottom of the housing 39, for example, by bonding. The block of foam 40 may have the same purpose as the block of foam 16 of the previous optional embodiment. The face of the block of foam 40 that faces towards the surface 36 may be in flow communication with the orifice 37 in which the emerging stem 29 may be mounted.

The housing 39 may end opposite the orifice 37, in a free edge delimiting an opening 41. The exterior surface of the housing 39 may have a screw thread 42 capable of cooperating with a corresponding screw thread 43 of a cap 38. An interior skirt 44 of the cap 38 may be used to attach an applicator member 45, for example, a rigid or semi-rigid block comprising felt, the surface of which may be covered with flock. The applicator member 45 may be attached to the skirt 44, for example, by bonding or welding. The applicator member 45 may substantially form a cone at the end of the attachment skirt 44.

When the applicator cap 38 is mounted on the device 1, as shown in FIG. 2B, the applicator element 45 may rest against the block of foam 40, thereby appreciably deforming the block of foam 40. This deformation may assist in creating a large area of contact between the applicator element 45 and the block of foam 40, such as when the block of foam 40 is substantially loaded with product P.

When the device 1 is used, the user may press on the rigid bottom 21 so as to actuate the dispenser 28. The product P passes through the emerging stem 29 and orifice 37, thereby loading the block of foam 40 with product P as it comes into contact with the applicator member 45. When the applicator cap 38 is opened, the decompression of the block of foam 40 may accelerate the pumping of the product P toward the surface of the block of foam 40 into contact with the applicator member 45. When the applicator member 45 is separated from the block of foam 40, it may be substantially satisfactorily laden with product P. Thereafter, the product P may be applied in a conventional manner to an appropriate surface.

Figure 3A:
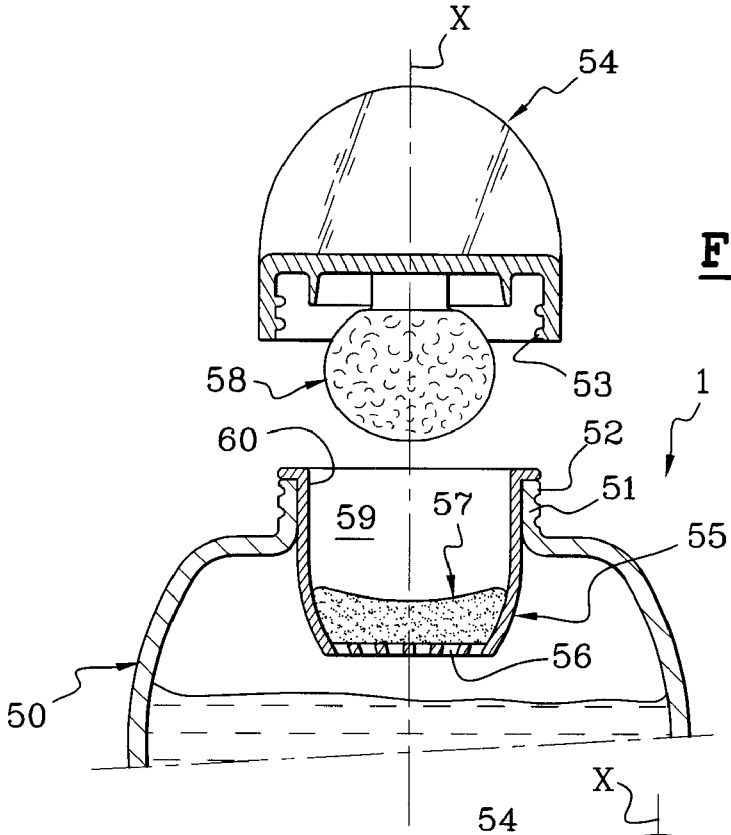
FIG. 3A is a schematic cross-sectional view of yet another optional embodiment of a device for applying a product.
Figure 3B:
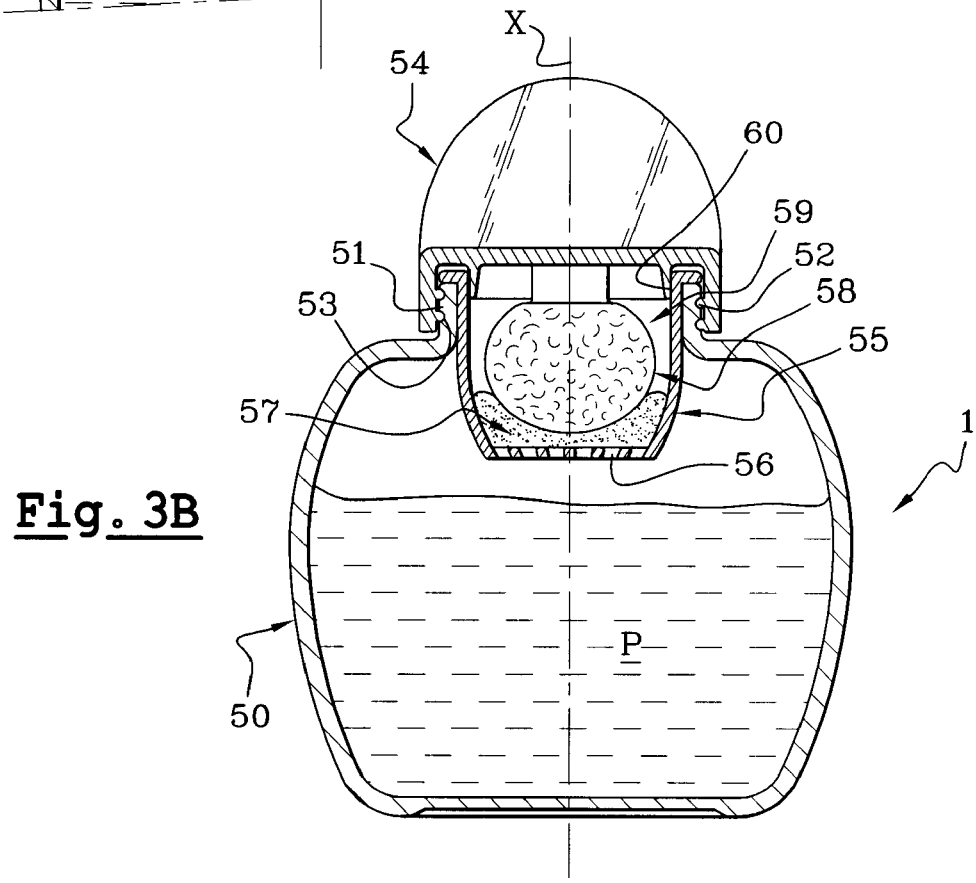
FIG. 3B is a schematic cross-sectional view of the embodiment of FIG. 3A with the applicator positioned in the housing.

In the optional embodiment of FIGS. 3A and 3B, the device 1 may comprise a glass container 50 surmounted by a neck 51, an exterior surface of which may be provided with a screw thread 52 capable of cooperating with an optional screw thread 53 of an applicator cap 54. Such a bottle 50 may contain a product P such as a perfume.

Optionally force-fitted into the neck 51 of the bottle 50, may be a cup 55, the bottom 56 of which may be perforated in the manner of a grating. The cup 55 may delimit a housing 59 intended to house an applicator 58 through an opening 60. Arranged in the bottom of the cup 55, above the perforated bottom 56, may be a block of foam 57, for example, an open-cell foam.

The applicator cap 54 may carry an applicator 58, which may be formed from an open-cell foam. The foam of the applicator 58 may have compressibility that is substantially the same as or lower than the compressibility of the block of foam 57. The applicator 58 and the cup 55 may be sized such that when the applicator cap 54 is fitted to the cup 55, as shown in FIG. 3B, the block of foam 57 may be compressed by the applicator 58.

The porosity of the block of foam 57 may be chosen such that the block of foam 57 may become substantially loaded with product P when the product P is brought into contact with the block of foam 57. This may occur, for example, as a result of the device 1 being shaken. Such shaking may occur naturally, for example, when the device 1 is carried in a handbag.

In the open position, as shown in FIG. 3A, the housing 59 may be isolated from the container 50 by the block of foam 57 engorged with product P, which may form a "liquid barrier" capable of appreciably reducing any evaporation of product P contained in the bottle 50. Additionally, when the device 1 is tipped or overturned, the product P may not flow from the device 1.

When the applicator cap 54 is mounted on the device 1, as shown in FIG. 3B, the applicator element 58 may rest against the block of foam 57 to the extent of appreciably deforming the block of foam 57. This deformation may play a part in creating a large area of contact between the applicator element 58 and the product-loaded block of foam 57.

When used, the user may shake the device 1 so as to bring product P into contact with the block of foam 57 via the perforated bottom 56. The product P may deeply impregnate the foam 57, and move by capillary action into the applicator 58.

Upon opening, the decompression of the block of foam 57 may accentuate the pumping of product P toward the applicator element 58. Furthermore, upon opening, optional relative rotation between the applicator element 58 and the block of foam 57 may allow the application surface to be wrung out so that any excess product P, such as in the form of drops, may be removed. Thereafter, the product P may be applied to a surface that is to be treated with the product P.

Figure 4:
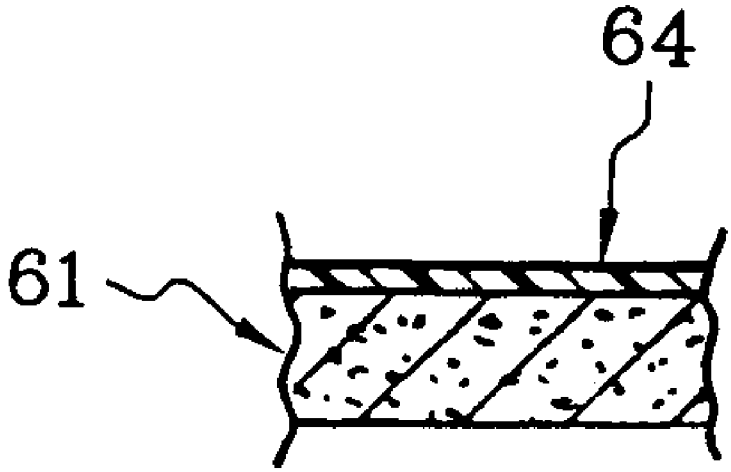
FIG. 4 is a partial, schematic cross-sectional view of an embodiment of a porous member.

FIG. 4 depicts an exemplary embodiment of a porous member 61 that may be at least partially covered with a sheet of material 64 that is permeable with respect to the product P. The sheet of material 64 may include at least one of a woven film, a non-woven film, and a perforated thermoplastic sheet.

The objects according to the optional aspects of the invention contain any make-up, care treatment, or hygiene products, such as cosmetic, dermatological, or pharmaceutical compositions used for treating hair, skin lips, or nails. However, in its broadest aspects, the present invention could be used to package and dispense many other objects and substances.

Furthermore, sizes of various structural parts and materials used to make the above-mentioned parts are illustrative and exemplary only, and one of ordinary skill in the art would recognize that these sizes and materials can be changed as necessary to produce different effects or desired characteristics of the packaging and dispensing device.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A system for applying a product, the system comprising:

a first compartment;

a product contained in the first compartment;

a second compartment forming an applicator housing and defining an opening and an axis;

at least one supply orifice configured to provide flow communication between the first compartment and the second compartment;

an at least partially elastically compressible porous member in flow communication with the at least one supply orifice;

a closure element for removably closing the opening; and an applicator configured to be insoluble with respect to the product, wherein the applicator is configured to be placed in the applicator housing so that the applicator contacts the at least partially elastically compressible porous member and deforms the at least partially elastically compressible porous member in the direction of the axis of the second compartment.

2. The system of claim 1, wherein the applicator is secured to the closure element such that the closure element acts as a member for holding the applicator.

3. The system of claim 1, wherein the at least partially elastically compressible porous member comprises at least one of an open-cell hydrophilic foam, a semi-open-cell hydrophilic foam, a flexible sintered material, and a felt.

4. The system of claim 3, wherein the at least partially elastically compressible porous member comprises at least one of polyurethane and polyether.

5. The system of claim 3, wherein the at least partially elastically compressible porous member comprises at least one of ethylene vinyl alcohol and polyvinyl chloride.

6. The system of claim 1, wherein the at least partially elastically compressible porous member is at least partially covered with a sheet of material that is permeable with respect to the product.

7. The system of claim 6, wherein the sheet of material comprises at least one of a woven film, a non-woven film, and a perforated thermoplastic film.

8. The system of claim 1, wherein the at least partially elastically compressible porous member contains at least one of a bacteriostatic agent and a hydroabsorbent agent.

9. The system of claim 1, wherein the applicator comprises at least one of a rigid and a semi-rigid material.

10. The system of claim 9, wherein the applicator comprises at least one of a thermoplastic material, a felt, and a sintered material.

11. The system of claim 1, wherein the applicator comprises an elastically compressible material.

12. The system of claim 11, wherein the applicator comprises at least one of an open-cell foam, a semi-open-cell foam, and an elastomer.

13. The system of claim 1, wherein the applicator is at least partially covered with flocking.

14. The system of claim 13, wherein the flocking comprises at least one of rayon, nylon, viscose, silk, and polyester.

15. The system of claim 1, further comprising a perforated element affixed between the first compartment and the second compartment, the perforated element defining said at least one supply orifice, and the at least partially elastically compressible porous member being located in the second compartment adjacent the perforated element.

16. The system of claim 15, wherein the at least partially elastically compressible porous member is secured to the perforated element.

17. The system of claim 1, further comprising an annular rim defining the at least one supply orifice, wherein the at least partially elastically compressible porous member is positioned in the second compartment via the annular rim.

18. The system of claim 17, wherein the at least partially elastically compressible porous member is secured to the annular rim.

19. The system of claim 1, wherein the at least partially elastically compressible porous member is fixed at an axial position inside the second compartment.

20. The system of claim 1, further comprising a pump, wherein the pump supplies product from the first compartment to the second compartment.

21. The system of claim 20, wherein the pump is configured to be actuated via pressure applied against the bottom of the first compartment.

22. The system of claim 1, wherein the first compartment comprises a bottle having substantially rigid walls defining a fixed volume.

23. The system of claim 1, wherein the first compartment has a variable volume.

24. The system of claim 23, wherein the first compartment further comprises at least one of at least one deformable wall, a bellows, and a bottom forming a piston.

25. A method of applying a product, the method comprising:

providing the system of claim 1;

transferring product from the first compartment to the at least partially elastically compressible porous member;

loading the applicator with product from the at least partially elastically compressible porous member;

removing the closure element from the opening; and applying the product with the applicator.

26. The method of claim 25, wherein the product comprises at least one of one of a makeup product, a care product, a personal hygiene product, and a hair product.

27. The method of claim 26, wherein the product comprises at least one of a perfume, an eau de toilette, a milk, a lotion, an emulsion, a gel, a lipstick product, a foundation, and a hair product for applying at least one of highlights and lowlights.

28. The method of claim 25, wherein transferring product to the at least partially elastically compressible porous member comprises at least partially inverting the system.

29. The method of claim 25, wherein transferring product to the at least partially elastically compressible porous member comprises shaking the system.

30. The method of claim 25, wherein the first compartment comprises at least one elastically deformable wall and transferring product to the at least partially elastically compressible porous member comprises deforming the at least one elastically deformable wall.

31. The method of claim 25, wherein transferring product to the at least partially elastically compressible porous member comprises activating a pump.

32. The method of claim 25, wherein transferring product to the at least partially elastically compressible porous member comprises placing a valve in an open position.

33. The system of claim 1, wherein the at least partially elastically compressible porous member is configured to be compressed such that it has a reduced thickness dimension when deformed by the applicator.

34. A device for applying a product, the device comprising:

a first compartment for containing a product;

a second compartment forming an applicator housing and defining an opening and an axis;

at least one supply orifice configured to provide flow communication between the first compartment and the second compartment;

an at least partially elastically compressible porous member in flow communication with the at least one supply orifice;

a closure element for removably closing the opening; and an applicator substantially formed from at least one of an elastomeric material, a foam material, a sintered material, and a felt, wherein the applicator is configured to be placed in the applicator housing so that the applicator contacts the at least partially elastically compressible porous member and deforms the at least partially elastically compressible porous member in the direction of the axis of the second compartment.

35. The device of claim 34, wherein the applicator is at least partially covered with flocking.

36. The device of claim 35, wherein the flocking comprises at least one of rayon, nylon, viscose, silk, and polyester.

37. The device of claim 34, wherein the applicator is secured to the closure element such that the closure element acts as a member for holding the applicator.

38. The device of claim 34, wherein the at least partially elastically compressible porous member is at least partially covered with a sheet of material that is permeable with respect to the product.

39. The device of claim 38, wherein the sheet of material comprises at least one of a woven film, a non-woven film, and a perforated thermoplastic film.

40. The device of claim 34, wherein the at least partially elastically compressible porous member contains at least one of a bacteriostatic agent and a hydroabsorbent agent.

41. The device of claim 34, further comprising a perforated element affixed between the first compartment and the second compartment, the perforated element defining said at least one supply orifice, and the at least partially elastically compressible porous member being located in the second compartment adjacent the perforated element.

42. The device of claim 41, wherein the at least partially elastically compressible porous member is secured to the perforated element.

43. The device of claim 34, further comprising an annular rim defining the at least one supply orifice, wherein the at least partially elastically compressible porous member is positioned in the second compartment via the an annular rim.

44. The device of claim 43, wherein the at least partially elastically compressible porous member is secured to the annular rim.

45. The device of claim 34, wherein the at least partially elastically compressible porous member is fixed at an axial position inside the second compartment.

46. The device of claim 34, further comprising a pump, wherein the pump supplies product from the first compartment to the second compartment.

47. The device of claim 46, wherein the pump is configured to be actuated via pressure applied against the bottom of the first compartment.

48. The device of claim 34, wherein the first compartment comprises a bottle having substantially rigid walls defining a fixed volume.

49. The device of claim 34, wherein the first compartment has a variable volume.

50. The device of claim 49, wherein the first compartment further comprises at least one of at least one deformable wall, a bellows, and a bottom forming a piston.

51. A system for applying a product, the system comprising:

the device of claim 34; and a product comprising at least one of a makeup product, a care product, a personal hygiene product, and hair product.

52. The system of claim 51, wherein the product comprises at least one of a perfume, an eau de toilette, a milk, a lotion, an emulsion, a gel, a lipstick product, a foundation, and a hair product for applying at least one of highlights and lowlights.

53. A method of applying a product, the method comprising:

providing the system of claim 51;

transferring product from the first compartment to the at least partially elastically compressible porous member;

loading the applicator with product from the at least partially elastically compressible porous member;

removing the closure element from the opening; and applying the product with the applicator.

54. The method of claim 53, wherein transferring product to the at least partially elastically compressible porous member comprises at least partially inverting the system.

55. The method of claim 53, wherein transferring product to the at least partially elastically compressible porous member comprises shaking the system.

56. The method of claim 53, wherein the first compartment comprises at least one elastically deformable wall and transferring product to the at least partially elastically compressible porous member comprises deforming the at least one elastically deformable wall.

57. The method of claim 53, wherein transferring product to the at least partially elastically compressible porous member comprises activating a pump.

58. The method of claim 53, wherein transferring product to the at least partially elastically compressible porous member comprises placing a valve in an open position.

59. A system for applying a product, the system comprising:

a first compartment;

a product contained in the first compartment;

a second compartment forming an applicator housing and defining an opening;

at least one supply orifice configured to provide flow communication between the first compartment and the second compartment;

an at least partially elastically compressible porous member in flow communication with the at least one supply orifice;

a closure element for removably closing the opening; and an applicator configured to be insoluble with respect to the product, wherein the applicator is configured to be placed in the applicator housing so that the applicator contacts the at least partially elastically compressible porous member, and wherein the system is configured so that the product is urged under pressure from the first compartment to the at least partially elastically compressible porous member.

60. The system of claim 59, further comprising a pump configured to supply product from the first compartment to the at least partially elastically compressible porous member.

61. The system of claim 59, wherein the first compartment comprises flexible walls configured to reduce the volume of the first compartment to provide the pressure for urging the product from the first compartment to the at least partially elastically compressible porous member.

62. A system for applying a product, the system comprising:

a first compartment;

a product contained in the first compartment;

a second compartment forming an applicator housing and defining an opening;

at least one supply orifice configured to provide flow communication between the first compartment and the second compartment;

an at least partially elastically compressible porous member in flow communication with the at least one supply orifice;

a closure element for removably closing the opening; and an applicator configured to be insoluble with respect to the product, wherein the applicator is configured to be placed in the applicator housing so that the applicator contacts the at least partially elastically compressible porous member, wherein the closure element comprises first screw threading and the applicator housing comprises second screw threading, and wherein engagement of the first and second threading causes the closure element to removably close the opening, and wherein the system is configured so that the product is urged under pressure from the first compartment to the at least partially elastically compressible porous member.

63. The system of claim 62, wherein closure element has internal screw threading and the applicator housing has external screw threading.

64. The system of claim 62, wherein the screw threads are configured such that the applicator rotatably contacts the at least partially elastically compressible porous member when the closure element is rotated to an engagement position with respect to the applicator housing.

* * * * *

UNITED STATES PATENT AND TRADEMARK OFFICE

CERTIFICATE OF CORRECTION

PATENT NO. : 6,634,821 B2 
DATED : October 21, 2003
INVENTOR(S) : Jean-Louis H. Gueret It is certified that error appears in the above-identified patent and that said Letters Patent is hereby corrected as shown below:

Column 12,
Line 50, "one of one of a" should read -- one of a --.

Column 13,
Line 63, "the an annular" should read -- the annular --.

Signed and Sealed this

Sixteenth Day of December, 2003

JAMES E. ROGAN
*Director of the United States Patent and Trademark Office*